United States Patent [19]

Meyer

[11] 4,073,438

[45] Feb. 14, 1978

[54] SPRINKLER HEAD

[75] Inventor: Larry P. Meyer, Walla Walla, Wash.

[73] Assignee: Nelson Irrigation Corporation, Walla Walla, Wash.

[21] Appl. No.: 720,395

[22] Filed: Sept. 3, 1976

[51] Int. Cl.[2] ..... B05B 3/04

[52] U.S. Cl. ..... 239/227; 239/237

[58] Field of Search ..... 239/227, 229, 237, 240, 239/DIG. 1, DIG. 16

[56] References Cited

U.S. PATENT DOCUMENTS

| | | | |
|---|---|---|---|
| 2,639,191 | 5/1953 | Hruby, Jr. | 239/DIG. 1 X |
| 3,091,400 | 5/1963 | Aubert | 239/229 X |
| 3,357,643 | 12/1967 | Hruby, Jr. | 239/227 X |

FOREIGN PATENT DOCUMENTS

| | | | |
|---|---|---|---|
| 719,424 | 3/1942 | Germany | 239/DIG. 1 |

*Primary Examiner*—Robert W. Saifer

*Attorney, Agent, or Firm*—Cushman, Darby & Cushman

[57] ABSTRACT

A sprinkler head comprising a stationary sprinkler body structure defining an inlet adapted to be connected with a source of water under pressure and a water-tight chamber communicating with the inlet, a movable tubular water distributing structure providing an inlet and a spaced discharge nozzle in flow communication relation therewith, a ball and socket connection for (1) mounting the water distributing structure on the sprinkler body structure with the inlet thereof within the chamber and the discharge nozzle exteriorly of the chamber for (a) rotational movement about a generally upright axis and (b) orbital movement in which the rotational axis of the water distributing structure describes a pair of cones whose apexes join at a point coinciding with the center of the ball and socket connection, and (2) providing a water-tight seal for the chamber between the sprinkler body structure and the water distributing structure in any position of movement thereof, a swirl plate within said chamber and an inverted cup-shaped element on the water distributing structure operable in response to the flow of water from the sprinkler body structure inlet to the discharge nozzle for effecting the aforesaid orbital movement of said water distributing structure, and a disk on the water distributing structure in rolling contact with the sprinkler body structure for effecting a fractional rotational movement of the water distributing structure during each orbital movement thereof.

23 Claims, 3 Drawing Figures

SPRINKLER HEAD

This invention relates to water sprinklers and more particularly to water sprinklers of the internal drive type.

It is generally accepted that a given source of water can be distributed to the greatest area by discharging it upwardly and outwardly through a nozzle and effecting a relatively slow rotational movement of the nozzle about an upright vertical axis. The most widely accepted sprinkler operating on this principle is the so-called impact sprinkler. An impact sprinkler head includes an exteriorly mounted impulse spoon which is oscillated by engagement with the stream issuing from the discharge nozzle of the sprinkler head. The impact of the spoon arm with the sprinkler body at the end of each oscillating cycle serves to impart a step-by-step rotary motion to the nozzle while the engagement of the spoon with the stream serves to distribute the water close in. The overall distribution pattern of these sprinklers is generally accepted to be superior to stationary sprinkler heads or to whirling sprinkler heads.

Throughout the many years impact sprinklers have enjoyed widespread acceptance, efforts have been made to provide a nozzle type distributing head with a smoother slower rotational movement by various internal drive arrangements. The units of this type which have become commercially available have generally involved the utilization of a multiplicity of gears materially increasing the costs involved. There still exists a need for a sprinkler head of the nozzle type having a structurally simple drive which can be economically produced and yet which can function effectively to rotate the nozzle with a relatively smooth action and relatively slow speed.

An object of the present invention is to provide a sprinkler head which fulfills the above-identified need. In accordance with the principles of the present invention this objective is obtained by utilizing a ball and socket type assembly for connecting a nozzle type water distributing structure within a sprinkler body structure for rotational movement about an upright axis and for orbital movement in which the rotational axis of the water distributing structure describes a pair of cones whose apexes join at a point coinciding with the center of the ball and socket assembly, the latter also serving as a liquid-tight seal for a water chamber within the sprinkler body structure in communication with the inlet of the water distributing structure. Disposed within the chamber in operative relation with the water distributing structure is a simple structural arrangement operable by the internal flow of water to effect the orbital movement of the water distributing member. The preferred form of the orbiting arrangement consists of a swirl plate within the chamber and an integral inverted cup-like portion on the lower end of a tubular water distributing nozzle member which is moved orbitally by the swirling motion of the water established by the swirl plate. Finally, a further simple structural arrangement is provided for effecting a fractional rotational movement of the water distributing structure during each orbital movement thereof. The preferred form of this latter arrangement consists essentially of a disk fixed to the aforesaid nozzle member with its axis concentric to the axis of rotation and spaced preferably below the point of joinder of the apexes of the cones described in the orbital movement. The disk is of relatively large diameter and has its periphery disposed in rolling engagement with the stationary sprinkler body structure. The preferred arrangement provides the structural simplicity of only three basic assemblies: one, the stationary sprinkler body; two, the movable water distributing structure with its integral inverted cup-shaped portion and fixed disk; and three, the ball and socket assembly connecting the same in sealed relation as aforesaid. The arrangement is not only simple structurally (and therefore economical to produce) but quite effective in operation in that the orbital movement in conjunction serves to distribute the water close in as well as to the outer reaches of the circular distribution pattern during the relatively smooth and slow rotational movement of the discharge nozzle.

These and other objects of the present invention will become more apparent during the course of the following detailed description and appended claims.

The invention may best be understood with reference to the accompanying drawings, wherein an illustrative embodiment is shown.

Referring now more particularly to the drawings, there is shown therein a sprinkler head, generally indicated at 10, which embodies the principles of the present invention. The sprinkler head 10 consists essentially of a stationary sprinkler body structure, generally indicated at 12, a movable water distributing structure, generally indicated at 14, a ball and connecting assembly, generally indicated at 16, for mounting the water distributing structure 14 on the sprinkler body structure for rotation about a general upright axis and for orbital movement wherein the rotational axis of the water distributing member 14 describes a pair of cones having their apexes joined at a point which coincides with the center of the ball and socket assembly. The sprinkler head 10 further includes orbiting means, generally indicated at 18, for effecting a continuous orbital movement of the water distributing structure 14 in response to the flow of water internally through the sprinkler head and a fractional rotating arrangement, generally indicated at 20, for effecting a fractional rotation of the water distributing structure 14 during each orbital movement thereof.

Figure 1:
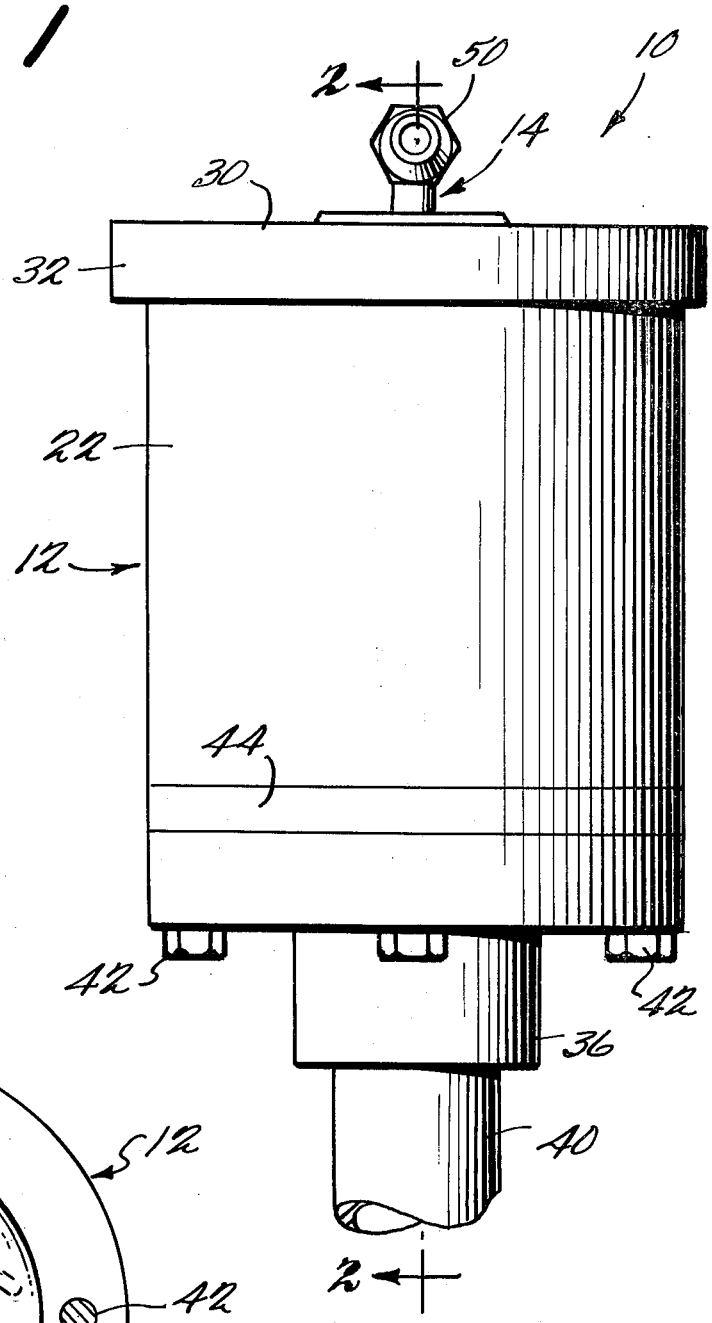
FIG. 1 is a front elevational view of a sprinkler head embodying the principles of the present invention.
Figure 3:
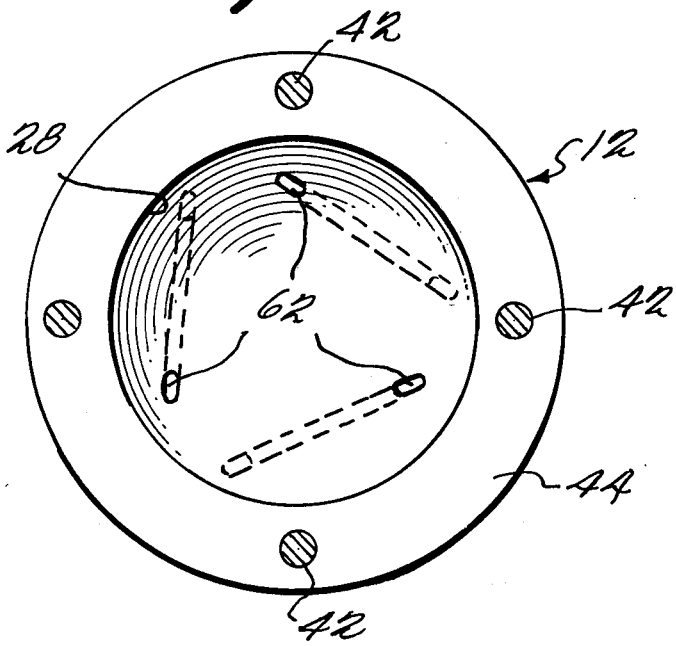
FIG. 3 is a sectional view taken along the line 3—3 of FIG. 2.
Figure 2:
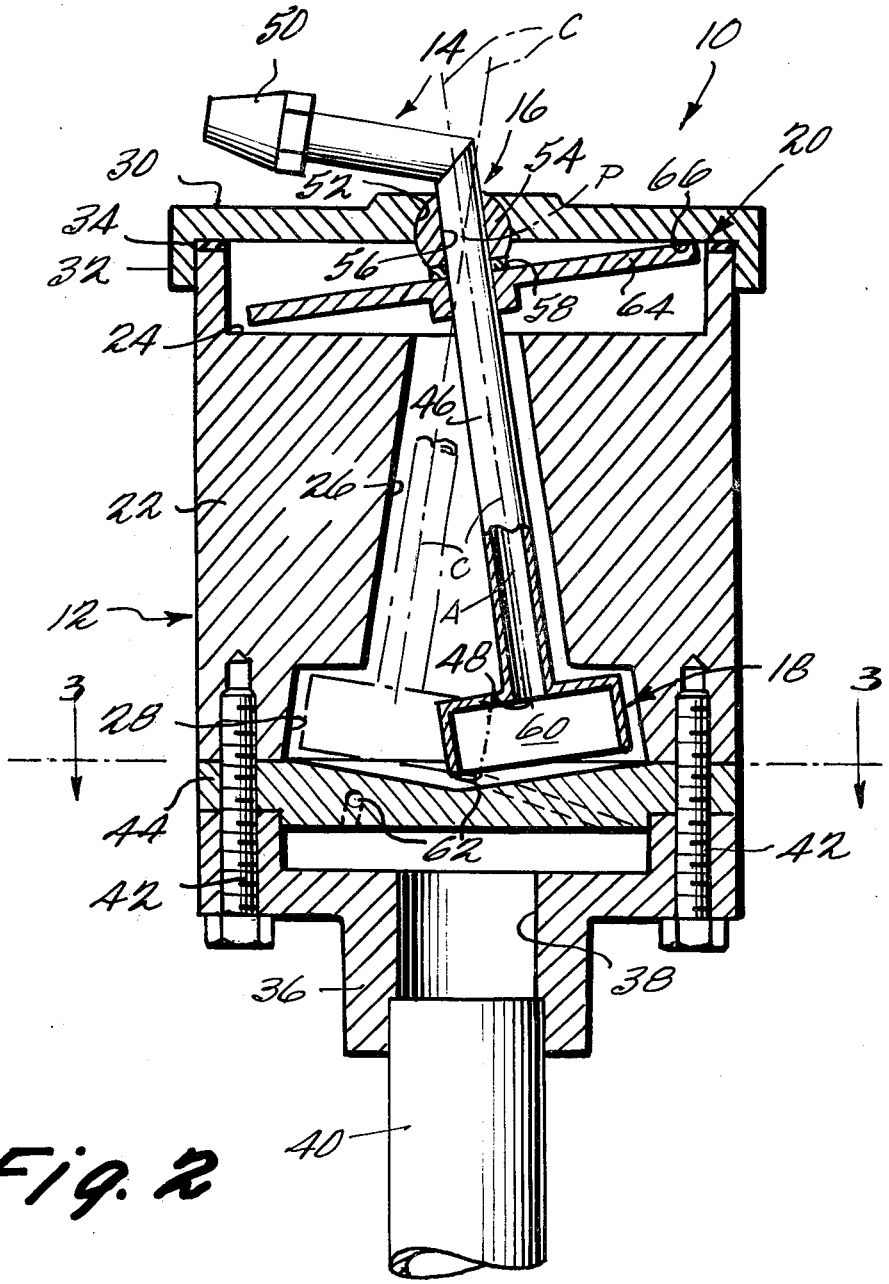
FIG. 2 is an enlarged sectional view taken along the line 2—2 of FIG. 1.

As best shown in FIG. 2, the sprinkler body structure 12 includes a main body member 22, which, as shown, is preferably of cylindrical exterior shape having a central cavity formed therein, having a configuration which includes an upper upwardly opening cylindrical portion 24, a central inverted frustoconical portion 26 and a lower enlarged downwardly opening frustoconical portion 28. The upper cavity portion 24 is closed by an upper sprinkler body lid member 30 having an interiorly threaded skirt 32 cooperatively engaging exterior threads on the upper end of the body member 22. A suitable gasket 34 provides a water-tight seal between the threaded connection.

The sprinkler body structure 12 also includes a lower inlet member 36 having an inlet opening 38 which is interiorly threaded to cooperatively engage an inlet pipe 40 providing a source of water under pressure. The inlet member 36 is fixedly connected to the lower end of the sprinkler body member 22 by a series of annularly spaced bolts 42 which also serve to fixedly secure a swirl plate member 44 between the inlet member 36 and the body member 22.

The movable water distributing structure 14 is preferably formed of an elongated tubular member 46 which includes a straight internal lower portion and an angular exterior upper portion. The tubular member 46 includes an inlet 48 at its lower end and a discharge nozzle 50 at its upper end. As shown, the axis of the straight portion of the tubular member 46 constitutes the axis of rotation of the water distributing structure 14. As shown, the axis of the upper angular portion describes an included angle of approximately 108° with the axis of rotation.

The ball and socket assembly 16 preferably includes a generally semi-spherical socket 52 formed in the central portion of the lid member 30 and opening downwardly. A ball member 54 is mounted with its exterior surface in sliding sealing engagement with the socket 52. The ball member 54 includes a cylindrical bore 56 extending therethrough which slidably sealingly receives the exterior periphery of the tubular member 46. As shown the lower end of the ball member 54 is cut off to provide a downwardly facing annular surface which engages the upper surface of a washer 58 disposed in surrounding relation to the exterior periphery of the tubular member 46.

The orbital movement effecting means 18 is preferably in the form of an integral inverted cup-shaped member 60 fixedly engaged on the lower end of the tubular member 46 to move therewith about an orbital path within the lower cavity portion 28. The swirl plate member 44 constitutes a part of the orbiting means and is provided with a series of openings 62 extending both angularly and longitudinally therethrough so as to impart a swirling motion to the water flowing internally within the cavity portion 28 of the chamber defined by the interior surfaces of the inlet member 36, all of the cavity portions of the body member 22 and the interior surfaces of the lid member 30. It will be noted that the ball and socket assembly 16 provides a seal for this water-tight chamber between the sprinkler body structure 12 and the water distributing structure 14.

The fractional rotation movement effecting means 20 preferably includes a flat disk 64 fixed concentrically to the exterior periphery of the tubular member 46 in a position such that the upper surface adjacent the tubular member 46 engages the lower surface of the washer 58. The exterior periphery of the disk 64 is disposed in rolling contact with the under surface of the lid member 30, as indicated at 66.

OPERATION

The sprinkler head 10 when at rest will assume the position substantially as shown in FIG. 2. The sprinkler head 10 as shown is mounted on the upper end of a riser pipe 40 of the type used in agricultural sprinkler irrigation. It will be understood that the sprinkler head may be utilized with suitable base modification as a lawn sprinkler. Likewise, it may be embodied as part of a pop-up sprinkler assembly for turf sprinkler irrigation. In this regard the term "stationary" used in describing the sprinkler body structure is used in a relative sense (with respect to the water distributing structure) and not in an absolute sense. For example, the sprinkler head itself could be carried by a movable irrigation system; hence, making the body structure movable in operation.

It will be noted that when the source of water pressure within the inlet pipe 40 is communicated with the inlet 38, the water will fill the internal chamber. In this regard, the seal provided by the ball and socket assembly 16 is water-tight but does not necessarily seal against air trapped in the upper cavity portion 24. Moreover, even should an air pocket be trapped in the upper cavity portion 24, normal operation will not be impaired as will be apparent hereinafter. As soon as the internal chamber is filled or substantially filled, the water therein enters the inlet 48 of the tubular member 46 and flows therefrom through the tubular member outwardly of the discharge nozzle 50. With a water flow thus established from the sprinkler body inlet 38 outwardly of the water distributing discharge nozzle 50, the portion of this flow which takes place within the lower cavity portion 28 will have a swirling action imparted thereto by virtue of the direction of the flow both angularly and longitudinally through the openings 62. It will be noted that the symmetrical shape of the inverted cup-shaped member 60 is such that the direction of the water flow outwardly of the openings 62 and the swirling movement of the water within the cavity portion 28 will be transmitted to the tubular member 46 as an orbital movement along an orbital path within the cavity portion 28. Since the cup-shaped member 60 is fixed to the tubular member 46 an orbital movement of the latter will take place wherein its axis of rotation, indicated by the reference character A in FIG. 2 of the drawings, describes a pair of cones C whose apexes join at a point P coincident with the center of the ball and socket assembly 16. It will also be noted that this orbital movement within the frustoconical activity portion 26 will serve to stir the water therein so that its movement tends to maintain the orbital movement impaired as a result of the swirl of water established within the cavity portion 28 by the openings 62.

It can thus be seen that the swirl plate and inverted cup-shaped member arrangement of the oribiting means will serve to impart a continuous orbital movement to the tubular member so long as water under pressure from the source pipe 40 flows therein and out of the discharge nozzle 50. It will also be noted that the pressure of the water flowing through the sprinkler head tends to urge the tubular member 46 upwardly with respect to the lid member 30, which upward movement is resisted by the washer 58 which may be of antifriction material such as Teflon or the like. This upward bias in conjunction with the orbital movement serves to maintain the exterior periphery of the disk 64 in rolling contact with the undersurface of the lid member. This rolling contact with the embodiment shown is a point contact which describes a circle on the lid under-surface whose center is substantially coincident with the center of the ball and socket assembly 16 and whose radius is equal to the horizontal distance between such center and the point 66 as shown in FIG. 2. The radius of the disk bears a ratio to the radius of the greater circle described by the point 66 which is equal to the cosine function of the angle between the two radii. In the preferred embodiment shown this angle is approximately 8°. The circumference of the disk which is a direct function of the radius (circumference $= 2\pi r$) will therefore bear a similar ratio to the circumference of the circle described by the point 66. Thus if the large circumference is assumed to be one, the smaller circumference will be equal to cosine 8° (0.9903). Thus, during each orbital movement the periphery of the disk will roll along the circle a distance equal to one which means that it will move angularly or rotationally about its axis of rotation a distance equal to one minus the cosine of the angle. During each orbital movement the tubular member will therefore have a fractional rotational movement about its axis which is equal to one minus the cosine of the angle divided by the cosine of the angle. In the preferred embodiment described a fractional rotation of less than 1% (approximately 0.98%) of a complete revolution of the tubular member about its axis takes place during each orbital movement. It will be realized that the rotational movement is continuous and is sufficiently slow that over a hundred orbital movements are required to effect one complete revolution of the tubular member 46 about its axis. The specific figures relating to the specific preferred embodiment shown are exemplary only and can be readily varied as desired while still retaining the principles of the present invention.

The combination of the orbital and rotational movements imparted to the tubular member 46 has two significant effects on the discharge nozzle and hence the stream issuing therefrom. Insofar as the slow rotation is concerned, the effect is to move the stream progressively in a circle in a manner similar to the step-by-step rotary movement of an impact sprinkler head except with a slow smooth continuous motion rather than a jerky step-by-step motion. The effect of the orbital movement is to periodically smoothly change the angle of inclination of the discharge nozzle axis between a maximum angle and a minimum angle which in the preferred embodiment shown is from a maximum 26° to the 10° minimum shown in FIG. 2. This somewhat more rapid periodic change in the angle of the stream issuing from the nozzle has the effect of distributing the water close in, in a manner equivalent to the water stream break-up of an impact sprinkler. Where additional in close water is desired a mesh screen can be provided around the outer edge of the lid member so that the stream shoots through the mesh when the nozzle is at its minimum angle positions.

It can thus be seen that the water distributing action of the present sprinkler head is comparable to that of an impact sprinkler except that a slow smooth rotational movement is provided rather than a jerky step-by-step rotational movement. This efficient distribution is obtained by a structural arrangement which is simpler than the structural arrangement of an impact sprinkler head. The present arrangement uses no springs either to return an impact arm or to provide functional control for the amount of frictional rotation. Essentially there is only one moving part. There are only two bearing areas, the ball and socket assembly and the peripheral point contact of the disk 64. While it is preferred to mount the disk 64 within the interior chamber of the sprinkler body it could be mounted exteriorly. Likewise, while the ball member 54 slidably receives the tubular member to provide for rotation of the latter about its axis, the ball member could be fixed on the tubular member with the ball movement within the socket providing the rotational movement.

It thus will be seen that the objects of this invention have been fully and effectively accomplished. It will be realized, however, that the foregoing preferred specific embodiment has been shown and described for the purposes of illustrating the functional and structural principles of this invention and is subject to change without departure from such principles. Therefore, this invention includes all modifications encompassed within the spirit and scope of the following claims.

What is claimed is:

1. A sprinkler head comprising;

a stationary sprinkler body structure defining an inlet adapted to be connected with a source of water under pressure and a water-tight chamber communicating with said inlet;

a movable water distributing structure providing inlet means and spaced discharge nozzle means in flow communication relation therewith, ball and socket connecting means for (1) mounting said water distributing structure on said sprinkler body structure with said inlet means within said chamber and said discharge nozzle means exteriorly of said chamber for (a) rotational movement about a generally upright axis and (b) orbital movement in which the rotational axis of said water distributing structure describes a pair of cones whose apexes join at a point coinciding with the center of said ball and socket connecting means, and (2) providing a water-tight seal for said chamber between said sprinkler body structure and said water distributing structure in any position of movement thereof, means within said chamber operable in response to the flow of water from said sprinkler body structure inlet to said discharge nozzle means for effecting the aforesaid orbital movement of said water distributing structure, and means acting between said water distributing structure and said sprinkler body structure for effecting a fractional rotational movement of said water distributing structure during each orbital movement thereof.

2. A sprinkler head as defined in claim 1 wherein said water distributing structure comprises a tubular member including a portion concentric with said rotational axis disposed in depending relation with respect to said ball and socket connecting means within said chamber.

3. A sprinkler head as defined in claim 2 wherein said orbital movement effecting means comprises an inverted cup-shaped portion on the lower end of said tubular member movable with the latter in an orbital path within said chamber and means for causing the water flowing in the portion of the chamber defining the orbital path of said inverted cup-shaped portion to swirl whereby the swirling movement of the water acts upon said cup-shaped portion to effect the orbital movement of the tubular member.

4. A sprinkler head as defined in claim 3 wherein said water distributing structure includes a continuation of said tubular member extending concentrically upwardly from said ball and socket connecting means and then upwardly and outwardly with its axis at an angle to said rotational axis.

5. A sprinkler head as defined in claim 4 wherein said fractional rotation effecting means comprises a disk fixed to the tubular member in concentric relation thereto, said disk having a periphery disposed in rolling engagement with said sprinkler body structure.

6. A sprinkler head as defined in claim 5 wherein said sprinkler body structure includes a disk-shaped upper member within which said ball and socket connecting means is concentrically mounted, the lower surface of said disk-shaped member including a portion defining a portion of said chamber rollingly engaging the periphery of said disk.

7. A sprinkler head as defined in claim 6 wherein said disk is flat and is fixed to said tubular member at a position spaced below the point of joinder of the apexes of the aforesaid cones a distance substantially less than the radius of said disk.

8. A sprinkler head as defined in claim 7 wherein said ball and socket connecting means includes a generally semi-spherical socket portion formed in said disk-shaped member and a ball member having its exterior periphery slidably sealingly engaged within said socket portion.

9. A sprinkler head as defined in claim 8 wherein said ball member is formed with a cylindrical bore slidably receiving said tubular member.

10. A sprinkler head as defined in claim 9 wherein said ball and socket connecting means further includes a resilient washer surrounding said tubular member in operative engagement between the lower portion of said ball member and the adjacent upper portion of said disk.

11. A sprinkler head as defined in claim 2 wherein said water distributing structure includes a continuation of said tubular member extending concentrically upwardly from said ball and socket connecting means and then upwardly and outwardly with its axis at an angle to said rotational axis.

12. A sprinkler head as defined in claim 1 wherein said fractional rotation effecting means comprises a disk fixedly carried by said water distributing structure in concentric relation to the rotational axis thereof, said disk having a periphery disposed in rolling engagement with said sprinkler body structure.

13. A sprinkler head as defined in claim 12 wherein said sprinkler body structure includes a disk-shaped upper member within which said ball and socket connecting means is concentrically mounted, the lower surface of said disk-shaped member including a portion defining a portion of said chamber rollingly engaging the periphery of said disk.

14. A sprinkler head as defined in claim 13 wherein said disk is flat and is fixed to said tubular member at a position spaced below the point of joinder of the apexes of the aforesaid cones a distance substantially less than the radius of said disk.

15. A sprinkler head as defined in claim 1 wherein said ball and socket connecting means includes a generally semi-spherical socket portion formed in said sprinkler body structure and a ball member having its exterior periphery slidably sealingly engaged within said socket portion.

16. A sprinkler head as defined in claim 15 wherein said ball member is formed with a cylindrical bore slidably receiving said water distributing structure.

17. A sprinkler head comprising;

a stationary sprinkler body structure defining an inlet adapted to be connected with a source of water under pressure and a water-tight chamber communicating with said inlet;

a movable water distributing structure providing inlet means and spaced discharge nozzle means in flow communication relation therewith, means for (1) mounting said water distributing structure on said sprinkler body structure with said inlet means within said chamber and said discharge nozzle means exteriorly of said chamber for (a) rotational movement about a generally upright axis and (b) orbital movement in which the rotational axis of said water distributing structure describes a pair of cones whose apexes join at a point along said axis, and (2) providing a water-tight seal for said chamber between said sprinkler body structure and said water distributing structure in any position of movement thereof, means within said chamber operable in response to the flow of water from said sprinkler body structure inlet to said discharge nozzle means for effecting the aforesaid orbital movement of said water distributing structure, and means acting between said water distributing structure and said sprinkler body structure for effecting a fractional rotational movement of said water distributing structure during each orbital movement thereof.

18. A sprinkler head as defined in claim 17 wherein said water distributing structure comprises a tubular member including a portion concentric with said rotational axis.

19. A sprinkler head as defined in claim 18 wherein said tubular member includes an upper portion extending angularly from said concentric portion and having said discharge nozzle means in the terminal end thereof.

20. A sprinkler head as defined in claim 17 wherein said fractional rotation effecting means comprises a disk fixedly carried by said water distributing structure in concentric relation to the rotational axis thereof, said disk having a periphery disposed in rolling engagement with said sprinkler body structure.

21. A sprinkler head comprising;

a stationary sprinkler body structure defining an inlet adapted to be connected with a source of water under pressure and a water-tight chamber communicating with said inlet;

a movable water distributing structure providing inlet means and spaced discharge nozzle means in flow communication relation therewith, means for (1) mounting said water distributing structure on said sprinkler body structure with said inlet means within said chamber and said discharge nozzle means exteriorly of said chamber for (a) rotational movement about a generally upright axis and (b) orbital movement in which the rotational axis of said water distributing structure describes a pair of cones whose apexes join at a point along said axis, means within said chamber operable in response to the flow of water from said sprinkler body structure inlet to said discharge nozzle means for effecting the aforesaid orbital movement of said water distributing structure, and an annular member fixed concentrically on said water distributing structure and having a peripheral rolling relationship with said sprinkler body structure for effecting a fractional rotational movement of said water distributing structure about its axis during each orbital movement thereof.

22. A sprinkler head comprising;

a stationary sprinkler body structure defining an inlet adapted to be connected with a source of water under pressure and a water-tight chamber communicating with said inlet;

a movable water distributing structure providing inlet means and spaced discharge nozzle means in flow communication relation therewith, means for (1) mounting said water distributing structure on said sprinkler body structure with said inlet means within said chamber and said discharge nozzle means exteriorly of said chamber for (a) rotational movement about a generally upright axis and (b) orbital movement in which the rotational axis of said water distributing structure describes a pair of cones whose apexes join at a point along said axis, and (2) providing a water-tight seal for said chamber between said sprinkler body structure and said water distributing structure in any position of movement thereof, means within said chamber operable in response to the flow of water from said sprinkler body structure inlet to said discharge nozzle means for effecting the aforesaid orbital movement of said water distributing structure, and means acting between said water distributing structure and said sprinkler body structure for effecting a fractional rotational movement of said water distributing structure during each orbital movement thereof, the position of said discharge nozzle means being such as to direct the stream issuing thereform upwardly and outwardly at a vertical angle which continuously changes between minimum and maximum values by virtue of the orbital movement of said water distributing structure and which is progressively moved horizontally by virtue of the fractional rotational movements of said water distributing structure.

23. A sprinkler head as defined in claim 22 wherein said minimum and maximum angle values are 10° and 26°.

* * * * *